US007649472B1

(12) United States Patent
Paterno

(10) Patent No.: US 7,649,472 B1
(45) Date of Patent: Jan. 19, 2010

(54) INTEGRATED LIGHTING AND DETECTOR UNITS

(76) Inventor: David Joseph August Paterno, 923 S. Sparks St., State College, PA (US) 16801

( * ) Notice: Subject to any disclaimer, the term of this patent is extended or adjusted under 35 U.S.C. 154(b) by 280 days.

(21) Appl. No.: 11/724,531

(22) Filed: Mar. 15, 2007

Related U.S. Application Data

(63) Continuation-in-part of application No. 10/963,699, filed on Oct. 13, 2004, now abandoned.

(60) Provisional application No. 60/510,900, filed on Oct. 14, 2003, provisional application No. 60/641,746, filed on Jan. 7, 2005.

(51) Int. Cl.
*G08B 5/22* (2006.01)
*G08B 23/00* (2006.01)

(52) U.S. Cl. ..... 340/815.45; 340/517; 340/521; 340/332; 340/628; 307/116

(58) Field of Classification Search ..... 340/815.45
See application file for complete search history.

(56) References Cited

U.S. PATENT DOCUMENTS 3,739,226 A 6/1973 Seiter et al.
4,305,069 A 12/1981 Machen et al.
4,419,658 A 12/1983 Jarosz et al.
4,570,155 A 2/1986 Skarman et al.
4,901,461 A * 2/1990 Edwards et al. ..... 40/575
4,977,351 A * 12/1990 Bavaro et al. ..... 315/87
5,786,767 A 7/1998 Severino
6,249,221 B1 6/2001 Reed
6,492,907 B1 12/2002 McCracken
6,518,878 B1 2/2003 Skoff
6,819,257 B2 11/2004 Swieboda et al.
6,864,799 B2 3/2005 Popps et al.
7,378,976 B1 * 5/2008 Paterno ..... 340/628
2003/0092297 A1 5/2003 Reindle et al.
2003/0193799 A1 10/2003 Bohler
2005/0152128 A1 7/2005 Campman

* cited by examiner

*Primary Examiner*—Donnie L Crosland

(57) ABSTRACT

A multi-module facility safety or security notification system containing (a) a central control unit, (b) at least one sub-module containing a light source and a sensor for detecting the level of ambient light, (c) at least one sub-module containing at least one additional sensor that is not an ambient light sensor, and (d) a at least two user selectable illumination options capable of being selected from at least the central control unit. The minimum illumination options are first an option where the light sources will respond to the ambient light sensor and the other sensor (i.e. a night-light mode) and second, an option where the light sources do not respond to the ambient light sensor but does respond to a different sensor.

12 Claims, 8 Drawing Sheets

INTEGRATED LIGHTING AND DETECTOR UNITS

RELATED APPLICATIONS

This application is a Continuation-in-Part of application Ser. No. 10/963,699 filed Oct. 13, 2004, now abandoned, which claims the benefit of provisional patent application No. 60/510,900 filed Oct. 14, 2003 and application Ser. No. 11/318,099 filed Dec. 23, 2005, now U.S. Pat. No. 7,378,976, which claims the benefit of provisional patent application No. 60/641,746, filed Jan. 7, 2005.

FIELD OF THE INVENTION

The present invention relates generally to integrated lighting and detector units and more particularly to lighting and detector units installed in a residential or commercial building and suitable for use as a night-light or convenience light and for detecting one or more safety, security or other conditions in the immediate environment of the unit.

BACKGROUND OF THE INVENTION

Alarm detector units provide safety and are nearly ubiquitous in modern residential and commercial buildings. In developed societies, such detectors are usually required by building or construction codes. The most common type of detector is intended to sense fire and/or smoke and will initiate an audible and/or visual alarm when its sensors detect fire and/or smoke. While fire and smoke detectors are most common, many other types of detectors designed to make our environments safer, more secure, or just more convenient are known to those in the art. These include carbon monoxide, heat, motion, intrusion, and other alarm detectors. Many models work on standard building electrical current, with the option of a battery backup to keep the units functioning during occasional power outages. Some models also work solely on battery power. Another category of such units function as sub-modules of a multi-module system that typically includes a central control module.

Some new construction building codes further require that smoke/fire alarm units also inter-connect to each other, so that when any one unit detects an alarm condition, all units will sound their internal alarms throughout the building premises.

FIG. 1 is a block diagram that illustrates the basic components of presently available prior art alarm detector units. Present alarm detectors may include: power and communications connections 10, alternate power source 20, power conditioning 30, transistor logic 40, purpose specific detectors 50, and alarming devices 60. As described herein, power conditioning refers to filtering, rectifying, regulating, and/or dividing as appropriate to match the conditions of the power source to the circuit components.

A typical home smoke alarm for example connects to the alternating current house wiring for primary power, and may or may not include a backup battery. The unit performs power conditioning to convert the high voltage alternating current to a low voltage direct current, and when a backup battery is present, the transistor logic handles switching over to the battery only when the primary power is not present. The transistor logic continuously monitors signals from the smoke and/or heat detectors, and determines when a change in conditions exist that may indicate a fire, such as a rapid rise in temperature and/or density of air borne particles. When such an alarm event is determined by the transistor logic, it further exercises drive circuits to outputting devices such as audible alarms, and other alarm units through an interconnection line if present. When present, the interconnection communications between alarm detectors provides two way communications between multiple alarm detectors. Thus it allows a unit to receive alarm triggers from other units, and provides it a means to signal other units of alarm conditions it detects. Similarly, stand alone Carbon Monoxide detectors can be installed and optionally interconnected with other detectors.

Also typical are multi-module residential monitoring and alarm systems. These systems utilize a central control panel that interconnects with one or more sub-module input/output devices (FIG. 6). The control panel communicates with the input and output devices either by wired or wireless means, and may also include a means to notify appropriate emergency service providers, in the event of a fire, burglary, or panic event. Such systems, employ sub-modules as described above and illustrated in FIG. 1. Noteworthy, in such multi-module systems, when the sub-modules are connected by wired means, the central control panel typically contains the primary and backup power sources, and distributes continuous power to the various sub-modules, even during primary power interruptions.

Safety lighting units in commercial and residential buildings are also well known. These are generally low-level lights intended as "night-lights", convenience lighting, or for pathway lighting during emergencies or darkened conditions. These types of lighting units come in many variations ranging from integrated units powered on standard building electrical current that are typically found in commercial buildings to residential type night-lights that are portable, independent of one another, and either run on batteries or plug-in to a standard appliance outlet.

In addition to the individual detector units and safety lighting units commonly found in many buildings, it is also known, though much less common, to combine safety lighting and detectors in an integrated unit. Several issued United States patents and published patent applications provide illustrative examples including U.S. Pat. No. 4,305,069 to Machen et al., U.S. Pat. No. 4,419,658 to Jarosz et al., U.S. Pat. No. 5,786,767 to Severino, U.S. Pat. No. 6,249,221 to Reed, U.S. Pat. No. 6,492,907 to McCracken, and U.S. Pat. No. 6,819,257 to Swieboda et al.

The patent to Machen is to a personal smoke and fire detector and warning unit. This invention is a combination detector and alarm unit that comprises a battery powered personal unit and an AC/DC sustaining unit. It provides audible and visual alarms and an emergency light. The personal unit plugs into the sustaining unit for battery charge and provides an additional smoke and fire detector when used in this mode.

The patent to Jarosz discloses a portable combination light and smoke detector and power failure alarm. The unit will sound an alarm warning in the event of sensing smoke or a power failure and will supply a portable high intensity lamp. The unit can be operated with either AC or battery power and is intended to be useful for travelers at hotels, dormitories and the like. It is noted that this detector unit is not suitable for use as a night-light.

The patent to Severino is for a home safety system. This home safety system comprises a smoke detector, a carbon monoxide detector, an audible alarm, and a microphone connected to a transmitter. The unit is powered by AC current and by a battery. The invention also contains an emergency lighting system connected to the detectors and is adapted to turn on in the event of a power failure as well. It is also noted that the unit can be operated as a night-light.

The patent to Reed teaches an emergency detector door illumination system. The system can include a heat detector, a smoke detector, an audible alarm, and a pulsating light. The unit is integrated into a door and is not intended to be operated from standard AC outlets.

The patent to McCracken is for a smoke detector apparatus that is highly customizable in that many different types of accessories can be attached. The choice of accessories includes night-lights and carbon monoxide sensors. The unit is designed to operate from a standard AC outlet, but may include a battery backup.

The patent to Swieboda teaches a stand-alone detector unit that can be plugged via prongs into a standard AC receptacle. The unit is designed to sense conditions such as heat, gas, smoke, intrusion or position. The detector unit can also contain a source of illumination. The illumination source seems to be intended primarily for signaling an alarm condition. This invention focuses on an uncommon feature of the unit in that it has two housings that can be decoupled (but remain electrically connected) and mounted in different locations.

Some additional United States patents of which the present inventors are aware that disclose various detector/alarm and lighting combinations include U.S. Pat. Nos. 3,739,226 to Seiter et al., 4,570,155 to Skarman et al., and 6,864,799 to Popps et al. Additionally, the present inventors are aware of US Published Patent Applications 2003/0092297 to Reindle et al. and 2005/0152128 to Campman which each also appear to disclose at least one embodiment describing combination lighting and detecting devices.

While many attempts have been made to provide a combination device having both night or pathway lighting and a safety detector system, as evidenced by the variety of patents and patent applications discussed above, there continues to be a need for improved devices with additional features and/or functionality for the user. More specifically there is a need for a combination night-light and alarm detector capable of operating in multiple modes with a mode select means. These are the primary needs addressed by the present invention. Such a combination device also provides more value to off set the costs of installation per unit—each installation location providing at least twice the functionality as currently available devices afford.

Accordingly, the following are selected objects of various embodiments of the present invention:

It is an object of the present invention to provide a convenient night and/or pathway lighting unit that is integrated into a detector unit.

It is also an object of the present invention to provide a combined lighting and detector device that has a multimode selection means that enables the device to operate in a number of different modes.

It is an object of the present invention to provide a combination night-light and alarm detector that has a backup battery power such that illumination is provided even during a power outage.

It is a further object of the invention to provide a combination night-light and detector having user selectable illumination options that are directly linked to changes in conditions of the immediate environment as determined by one or more detectors.

It is also an object of the present invention to provide a multi-module facility safety or security system having at least one sub-module unit containing an illumination device and a mode select means.

It is also an object of the present invention to provide a multi-module facility safety or security system having at least one sub-module that is an integrated lighting and detector unit comprising at least one detector, an illumination device, and a mode select means.

SUMMARY OF THE INVENTION

The invention is an integrated lighting and detector unit comprising a light source, a sensor for detecting the level of ambient light, one or more additional sensors for detecting a change in a safety (e.g. a smoke alarm) or other condition of the immediate environment of the detector and a mode selection means having at least two user selectable illumination options. The two primary illumination options are (i) an option where the light source responds to the level of ambient light and the one or more other safety sensors; and (ii) an option where the light source does not respond to the level of ambient light, but does respond to one or more other safety sensors. The invention can also be embodied in a multi-module version wherein these features may be contained on the same or different sub-modules.

DETAILED DESCRIPTION OF THE INVENTION

Figure 1:
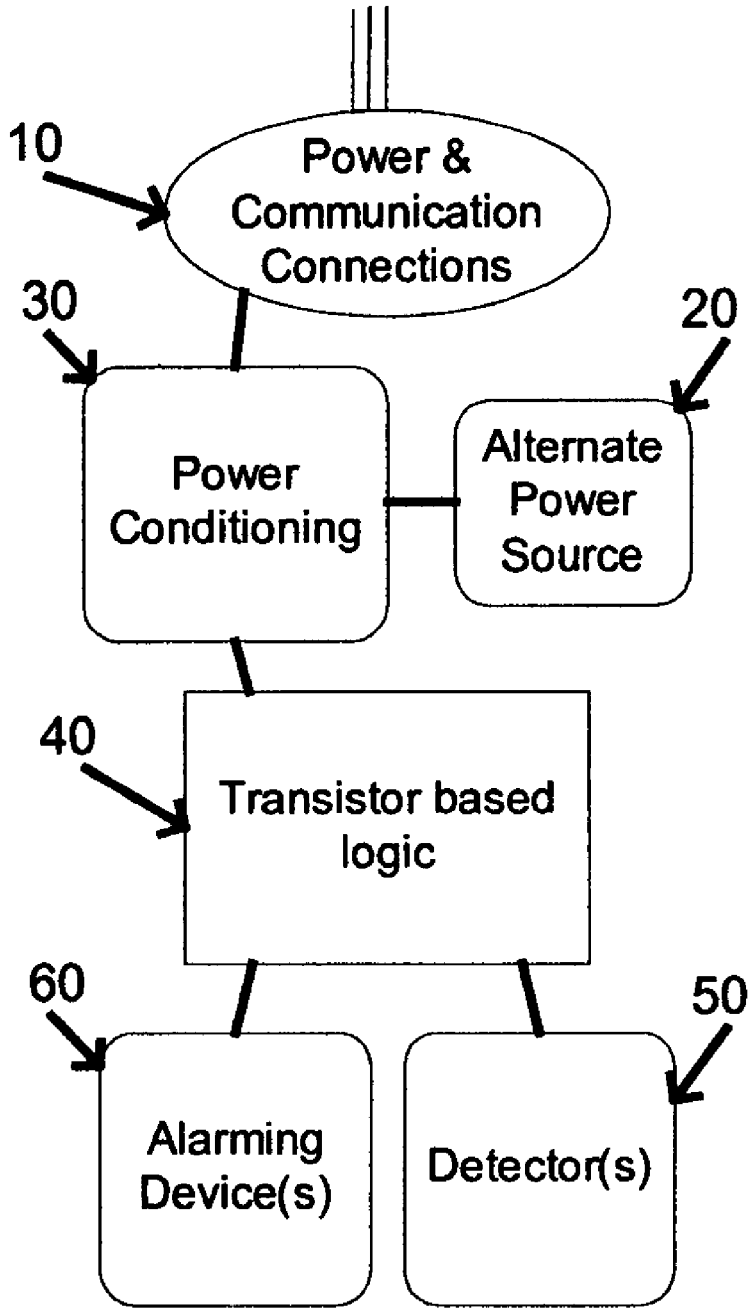
Figure 1. Prior Art
FIG. 1 is a block diagram that illustrates the basic components of prior art alarm detector units.
Figure 2:
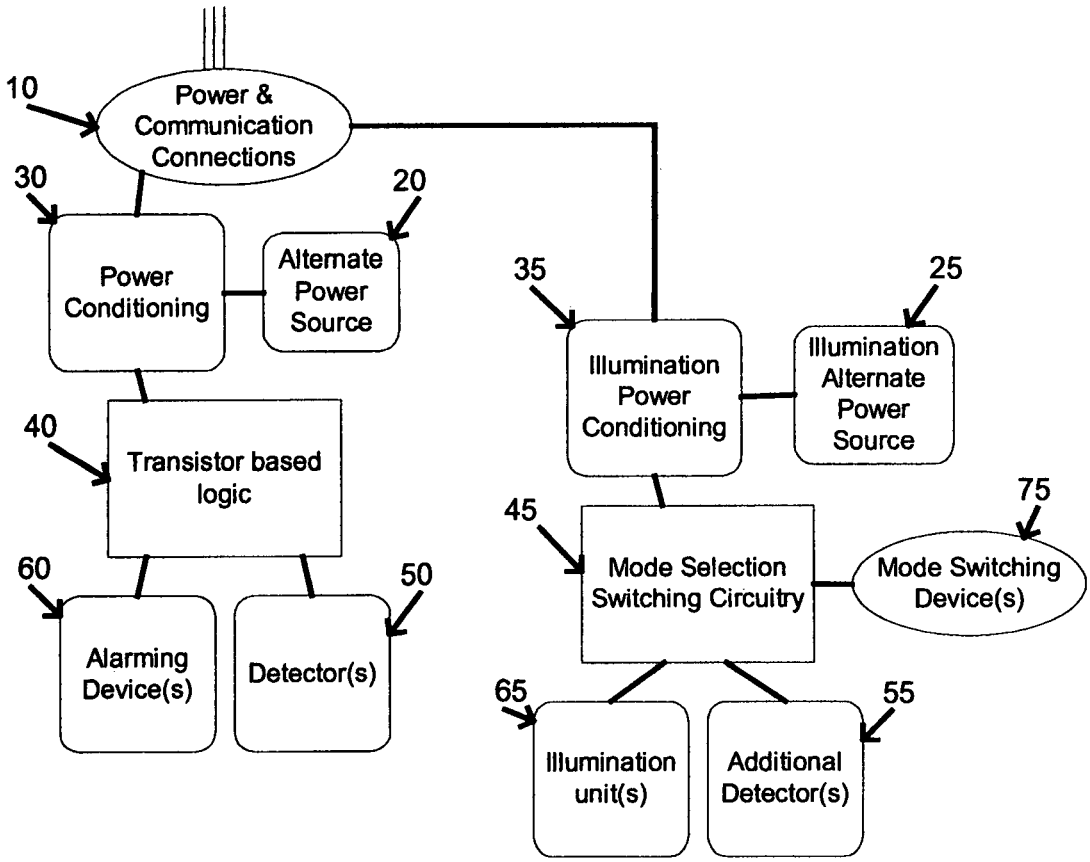
FIG. 2 is a block diagram that illustrates generically some embodiments of the present invention. The diagram includes optional components of the invention.

The invention will now be described by example with reference to the figures. FIG. 2 is a block diagram that illustrates generally some embodiments of the present invention. The present invention includes the general components of the alarm detector as show in FIG. 1 as described above as well as the additional components and features, some optional, introduced in FIG. 2 comprising: illumination power conditioning 35, illumination alternate power source 25, mode selection switching circuitry 45, mode switching device(s) 75, additional detector(s) 55, and illumination unit(s) 65.

Depending on choice of illumination units 65, installation specifics and regional building code requirements, it may be preferred for the present invention to include additional power conditioning 35 and additional alternate power source 25. For instance, certain illumination units can operate on the same voltage conditions as the alarm detector circuitry, while others cannot. In its preferred embodiment the present invention shares components for power conditioning, alternate power source, logic circuitry, and detectors between the two primary functions: alarm detection and illumination. The present invention provides alarm detection and convenience lighting in the proximity of the apparatus.

Figure 3:
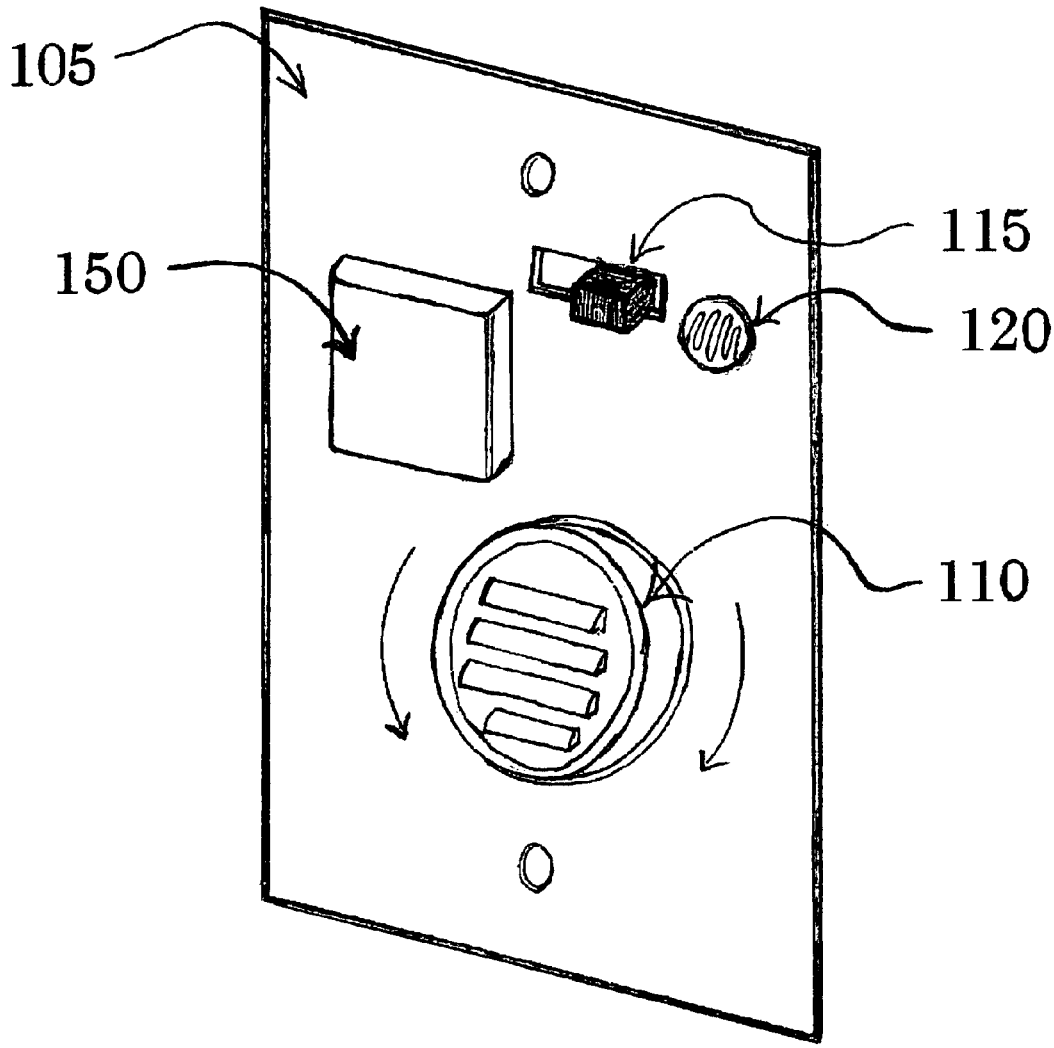
FIG. 3 is an arbitrary angle front perspective of an apparatus in accordance with an embodiment of the present invention.
Figure 4:
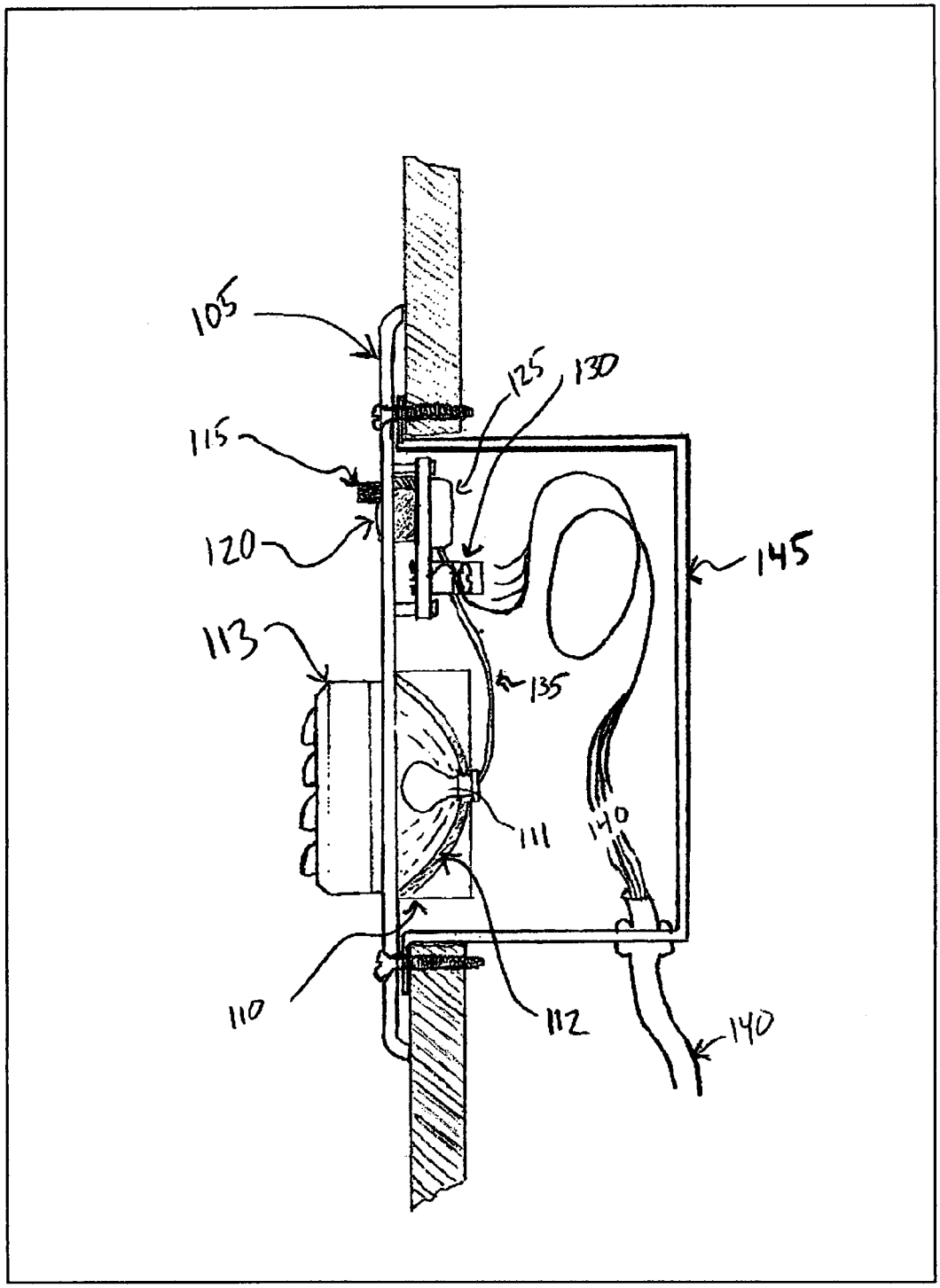
FIG. 4 is a side perspective of an apparatus in accordance with an embodiment of the present invention.

FIG. 3 shows one embodiment of the present invention in a front perspective view. In this example, the unit includes a mounting plate 105, an illumination device 110, a mode select switch 115, a detector for sensing a safety condition 150, and a light sensitive photo detector 120. FIG. 4 shows the same unit from the side and in a cut away view in a sample installation into a wall-wiring box. As shown, the lighting device can also includes logic and/or voltage regulating circuits 125, dis-connectable multi-conductor connectors 130, (screw terminal type shown), and electrical connections 135 to the illumination device 110. The wiring bus 140 may have fewer or more conductors dependent on the requirements of the specific embodiment and installation. This figure further illustrates an embodiment of the illumination device 110 that contains a light source 111, a reflector 112, a lens and a removable and rotate-able baffle 113 that provides a means for selectively directing the illumination. The fireproof electrical outlet box 145 shown, is not part of the present invention, but is included to illustrate one possible method of installation of this embodiment of the present invention. Not shown in this view is the safety condition sensor.

Figure 5A:
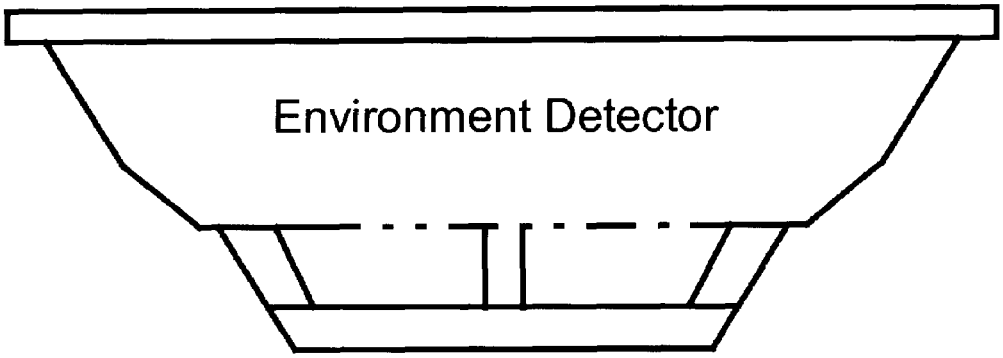
Figure 5a Prior Art
FIG. 5*a* is a side perspective that illustrates one embodiment of prior art environment detector units.
Figure 5B:
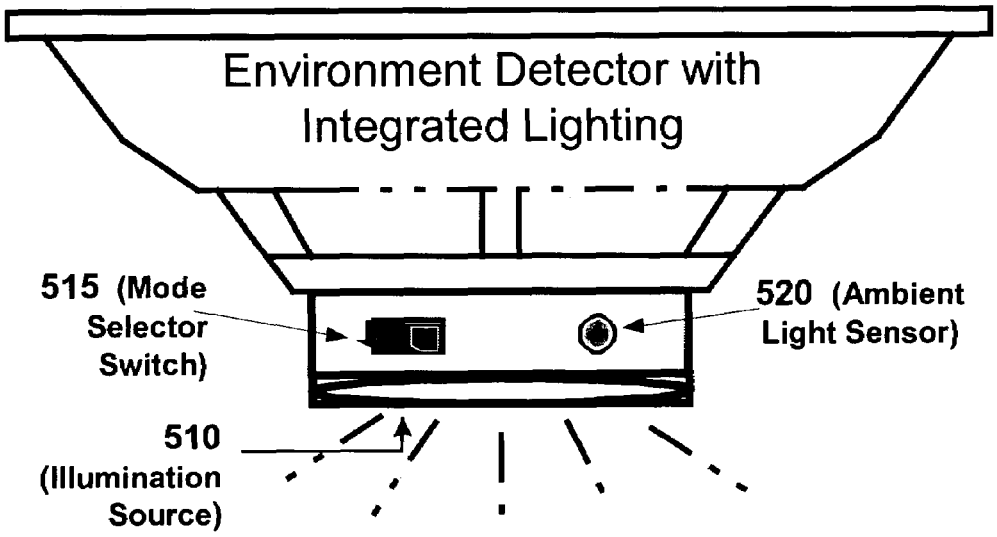
FIG. 5*b* is a side perspective of an apparatus in accordance with another embodiment of the present invention.

FIG. 5 shows an embodiment of the present invention in a different type of installation than the previous examples. FIG. 5*a* shows a prior art example of a typical environment detector, (i.e. smoke or carbon monoxide) which is installed generally on the ceiling or high on a wall. FIG. 5*b* shows this one type of design embodiment of the present invention with an illumination source 510, a mode selector switch 515, and an ambient light sensor 520. FIG. 5*b* is representative of one embodiment of the present invention that illustrates both a stand-alone application, and also a sub-module of a multi-module system application of the present invention.

Figure 6:
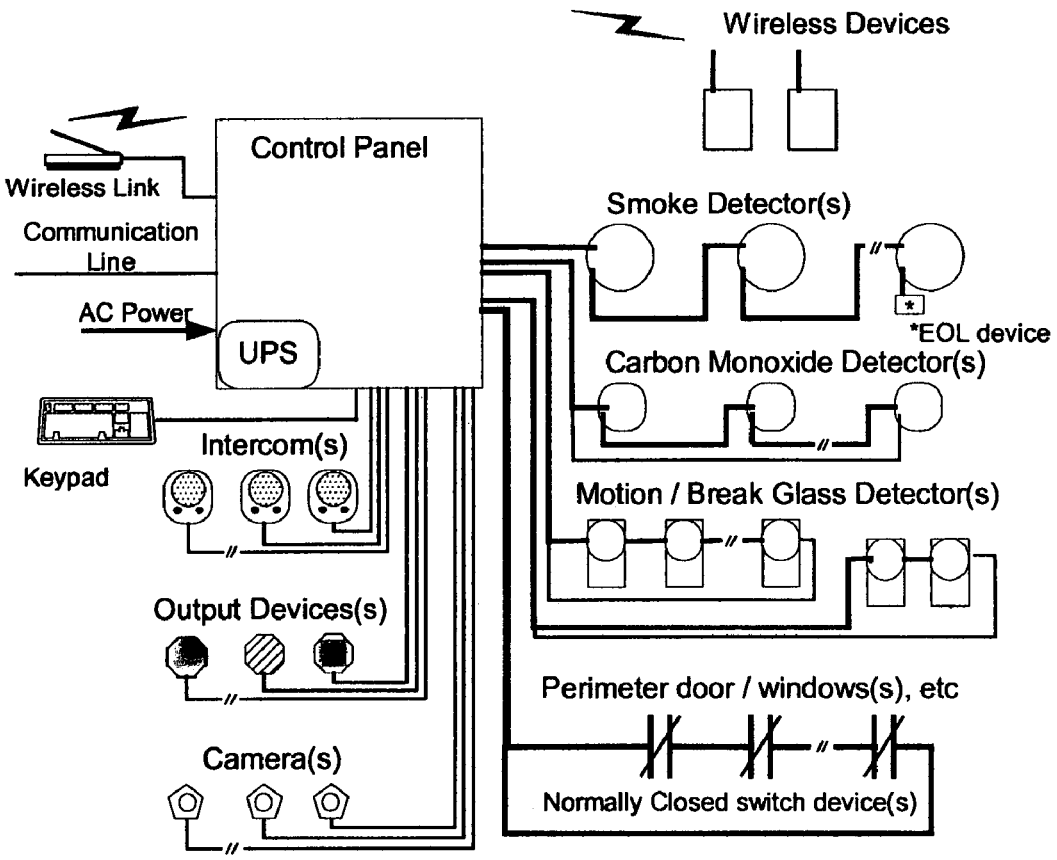
Figure 6. Prior Art
FIG. 6 is an illustration of the basic components of prior art multi-module monitoring and notification systems.

FIG. 6 illustrates a central control panel and numerous examples of the various types of sub-modules that can be present in prior art multi-module monitoring and notification systems. Which and how many of the various input and output device sub-modules is specific to the exact installation requirements. Suffice to say, that such systems contain at least one central control module, and one or more input/output sub-modules, such as motion detectors, smoke detectors etc.

Figure 7:
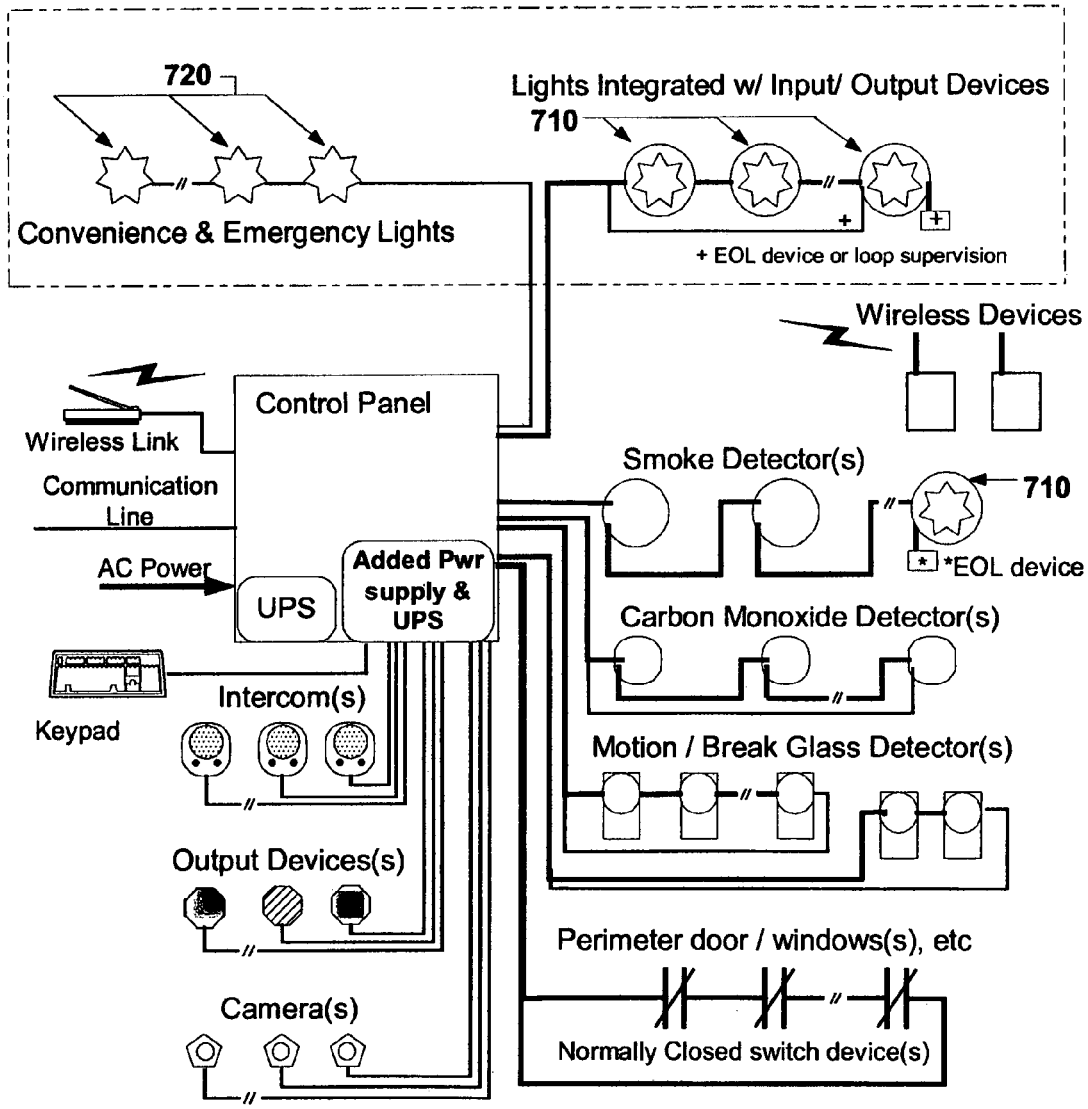
FIG. 7 is an illustration of the basic components of prior art multi-module monitoring and notification systems and includes examples of the present invention as a sub-module of a multi-module system.

FIG. 7 additionally includes examples of how the present invention could be embodied in a multi-module system. While it is illustrated in FIG. 7 with the present invention on its own branch circuit, there is no reason the present invention could not also be implemented as one or more sub-modules at any location on the same branch circuits as the existing prior art sub-module units. By way of description and not limitation, for example, it may be desirable to utilize an integrated smoke detector and convenience lighting unit embodiment of the present invention in a common hallway and children's bedrooms, with existing art smoke detectors in the garage and furnace room. Similarly an embodiment of the present invention that integrates the lighting with motion detector sub-modules could be utilized where convenience lighting is desired for night pathway illumination, power outage lighting, and alarm event convenience lighting. Worth noting, in such a multi-module system, the lighting responses at any and all various embodiments can be determined not just by the sensors within the sub-module itself, but can be affected and controlled by detectors in any of the other sub-modules on the system, including other various embodiments of the present invention, and conventional prior art sub-modules. Also note that while FIG. 7 generally shows multiple units of each sub-module type, the invention can have as few as one unit of any included type of sub-module.

Figure 8:
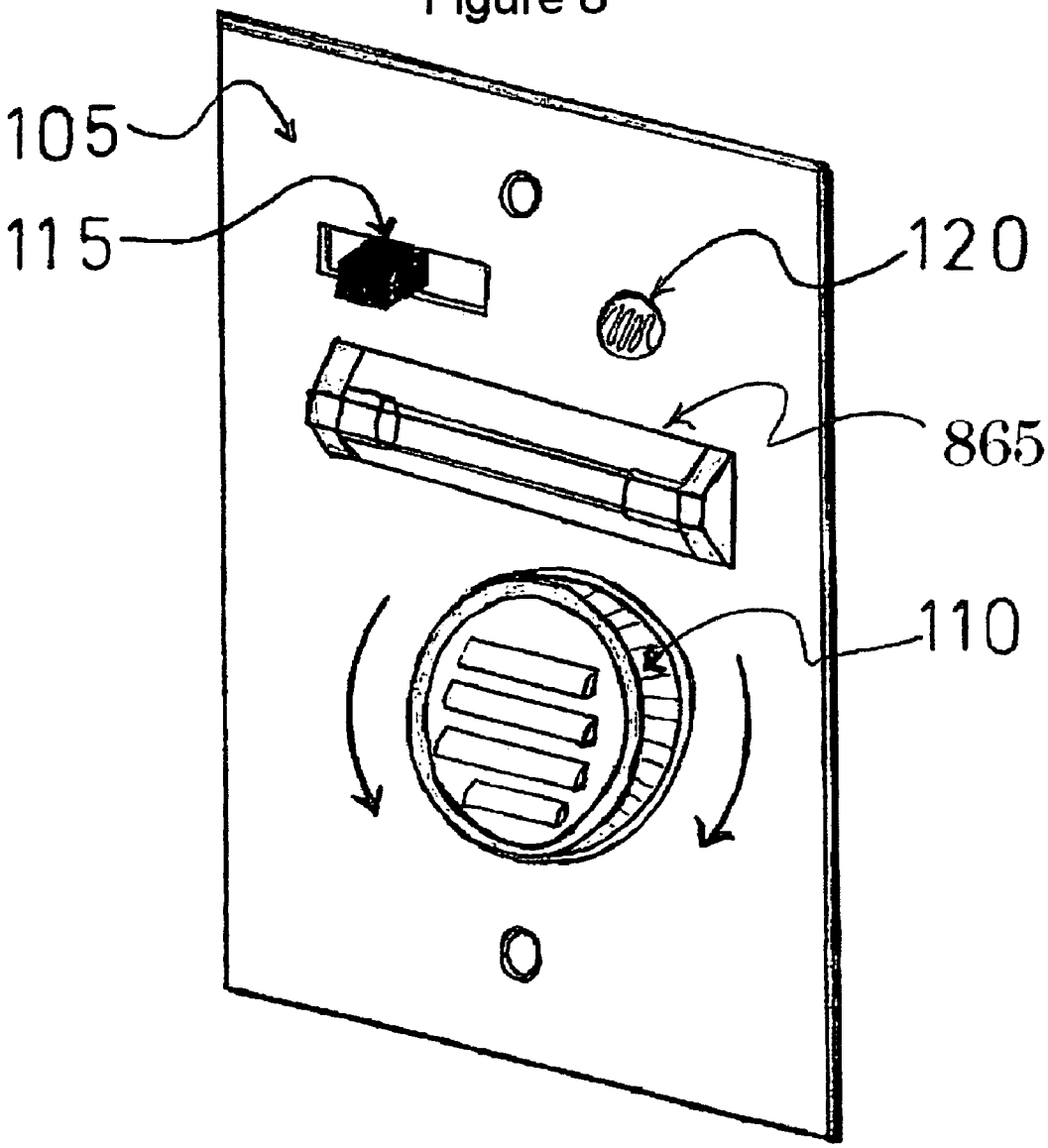
FIG. 8 is an arbitrary angle front perspective of an apparatus in accordance with an embodiment of the present invention.

FIG. 8 shows another embodiment of the present invention. This embodiment includes a special event signaling strobe light 865. This strobe light can signal to indicate any one of several special conditions at appropriate times as determined by control logic within the embodiment and/or control logic in other modules of the system.

The examples given in the figures and described above provide some specific embodiments of the present invention, however, in its most general form, in the stand-alone version of the invention, the invention is an integrated lighting and detector unit containing (a) a light source, (b) a sensor for detecting the level of ambient light, (c) one or more additional, non-light sensing, detectors for detecting a change in the environment in the vicinity of the unit, and (d) a means for providing at least two illumination options. The minimum illumination options are first an option where the light source will respond to a triggering condition signaled from the ambient light sensor or from another sensor present (e.g. a night-light and alarm mode) and second, an option where the light source does not respond to the level of ambient light but does respond to one or more other sensors (e.g. an alarm only mode). This minimum set of requirements assumes that any electrical or logic components (e.g. power conditioning and transistor based logic) required to operate these components as intended are included. In the multi-module version of the invention, these features can be contained in a single integrated sub-module unit or can be distributed over different parts of the system.

In the distributed embodiment, at least one sub-module will contain an illumination device and ambient light sensor and one or more other sub-modules may contain the additional required sensor. Additionally, the means for selecting the illumination options can be contained in any or all sub-modules, or even the central control unit.

The light source of the invention can vary considerably. The primary necessary feature of the illumination device is that it is suitable to operate as a night-light. Suitable light sources could be incandescent bulbs, LED devices, electroluminescent materials, etc. In preferred embodiments of the present invention the device uses a low power illumination source such as an LED illumination device. These provide years of operation, adequate pathway lighting, and consume about 100 milliWatts per LED light and could be operated from a battery power source. Further, they operate on low voltage direct current power that is compatible with standard smoke and carbon monoxide alarms.

Preferred embodiments of the invention also require a sensor for detecting the level of ambient light. This sensor is needed in order to operate the light source as a night-light. When operating in a mode that includes the night-light feature, the illumination device will turn on when the level of ambient light is below a certain threshold. The specific type of ambient light sensor is not a part of the present invention as these devices are commonly used and available from many sources. As long as the sensor is suitable for use in a night-light it will be useful in the present invention.

Preferred embodiments of the invention also include a secondary power source and circuitry to maintain continuous operation in the absence of primary power. The secondary power source and circuitry may be contained within the present invention, or located within the central control module of a multi-module system. Where such a secondary power source exists it may be preferred to include a primary power failure lighting option as part of the embodiment. In such an implementation the circuitry that senses the absence of primary power can be considered as just another type of "sensor" for detecting safety conditions for the purpose of this specification.

Another major component of the present invention is one or more sensors for detecting an environmental condition in the vicinity of the detector unit. The specific condition sensed or detected can vary widely. The major requirement is that it serves some practical need of a condition that the user desires to be notified of. This need can be a safety, security, alarm, or convenience need. Thus various conditions could be detected depending on the desired use of the device and the present invention is not limited to any specific type of detection. In the description herein detectors include but are not limited to: smoke, fire, temperature/heat, specific gas (e.g. carbon monoxide), motion, sound, light, and vibration detectors. More common and preferred types of detection devices useful in the present invention include smoke, fire, carbon monoxide, and motion detection. The specific mechanism used by the safety condition sensor is not a part of the present invention. Such devices are well known in the art and any device capable of sending a signal to trigger an alarm or signaling mechanism when a threshold level of a safety condition will be suitable.

The final major required component of the invention is a means to provide the device with multiple illumination options. In its simplest form this is simply a mechanical switch. Alternately the means of providing multiple illumination options can be handled in software code contained within the device, or an external unit that communicates the desired illumination options to the device by wired or wireless means. For example but not limitation, software code within the device could allow illumination selection to be changed when someone shines a bright light directly at the unit for predefined timing sequences, thus allowing a user to change the illumination settings from a short distance away from the unit. In the case of installation as a sub-module as part of a multi-module system, it may be preferred that the illumination modes, can be changed from a convenient programming interface that interacts with the system through the central control module. For simplicity of description, only the most basic mechanical switch means of changing the illumination option is shown in the figures.

For instance, the mode switching device(s) 75 in FIG. 2 allows a person to select the mode of lighting they desire. The switch will have at least two illumination options although it could have three, four or more options. The minimum illumination options are first an option where the light source will respond to a safety or other condition and to the level of ambient light (i.e. a night-light mode) and second, an option where the light source does not respond to the level of ambient light but does respond to one or more other sensors (e.g. an alarm or notification only mode).

The first required option for the mode switching devices 75 is the notification and night-light illumination mode. In this mode the present invention will activate illumination units 65 for notification (e.g. alarm) conditions and by utilizing the ambient light detector 55 will also illuminate convenient night light illumination when the ambient light level around the present invention is below a set threshold. In one embodiment of the present invention the alarm condition illumination and the night lighting illumination may be the same illumination scheme. In other embodiments, they will use the same light source but will operated them under different schemes; and, in still another embodiment the notification condition will use a different light source than the night light feature. In all cases, the alarm mode may make use of an audible alarm as well (not shown on any figures). A variation of this mode would include a motion or infrared detector 55 in the present invention used to initiate illumination based on a person entering the proximity of the unit.

The second required mode for the mode switching devices 75 is the alarm or notification only illumination mode. In this mode when the unit detects a predetermined condition that it is desired for a person to be notified of (e.g. smoke or motion detection) or receives a trigger from another detector, the mode selection switching circuitry activates the illumination units for alarm or notification condition illumination. In one embodiment of the present invention, the invention includes a unique illumination scheme just for alarm/notification conditions, such as a flashing strobe light.

Additional modes possible for the mode switching devices 75 are an "off" and a notification/alarm and/or power outage illumination mode. In general the off mode is not recommended for a device intended to be used for notification detection purposes and this option is not preferred in the present invention. In the alarm and power outage mode the present invention will likewise activate illumination units 65 for alarm conditions and using appropriate circuitry in the power conditioning module 35 will activate power outage illumination when the power conditioning module 35 is operating on the alternate power source and the detectors 55 indicate night light illumination conditions exist (lack of ambient light, or detection of a person in proximity to the unit). Also, in an alternative embodiment of the invention, the illumination device of the invention is illuminated constantly when the mode selected includes the night-light feature.

The power source for the invention can be standard AC circuitry or battery operated. The AC source could be obtained by directly wiring the device to standard building electrical sources or could be provided by plugging the unit into a standard appliance outlet. The unit could also be operated completely on battery power. In preferred embodiments of the invention, the unit is operated on AC power and contains a battery backup.

The invention also includes embodiment of the inventive concept in a multi-module facility safety, security, or notification system. This type of system will comprise a centralized control unit and multiple sub-modules. At least one sub-module will comprise a light source and a sensor for detecting the level of ambient light. The same sub-module and/or a different sub-module will contain one or more additional, non-light sensing, detectors for detecting a change in the environment in the vicinity of the unit. Further the multi-module system will contain a means for providing at least two illumination options. The means for selecting the illumination options can be contained in any or all sub-modules, or even the central control unit. Additional sub-modules can comprise other common input or output devices connected to the central unit (FIG. 7) whose specifics are also not critical to the invention. These input or output units can include: keyboards, intercoms, cameras, smoke detectors, heat detectors, carbon monoxide detectors, motion detectors, broken glass detectors, open door/window detectors or other detectors. There can be a single sub-module of any of these types or a series of them if desired.

The specific aspects of the centralized control unit of the multi-module version of the invention is not a critical aspect of the present invention. As will be known to those of skill in the art, as long as the unit is capable of centrally controlling the multiple sub-modules it will be acceptable for use in the invention. The unit can communicate with its various sub-module via a direct connection or through wireless means. The central control unit may have various features including monitoring for fire, burglary, and panic events among others.

It may include alarming devices that notify people in close proximity to the premises where it is installed and it may communicate the events to remote monitoring stations by wired or wireless means.

In both cases of application of the present invention; as a sub-module of a multi-module system and as a stand alone integrated illumination and environment detector unit; the effectiveness of the safety such installations of environment detectors can afford a premise is directly related to the number of and optimal placement of the devices that are installed. Because the incremental cost of the added lighting features of the present invention is small compared to the installed cost of the environmental detector, combining the functionality of convenience lighting will increase the value to install more integrated lighting and environment detectors in a premise. Thus increasing the overall safety of the premise for a small incremental cost.

The following example illustrates one of many possible uses of the present invention, so the utility of the invention can be more fully understood. A family may decide to install several smoke alarms and carbon monoxide alarms in their home. By choosing to use the present invention for some of these alarms, the family can enjoy convenient assistance on a daily basis, and improved safety during alarm events and power outages.

In the bedroom of their newborn baby, they set the unit to the alarm and night light illumination mode. They also set the unit in the bedroom hallway this way. For the unit in the parent's bedroom however, they select the alarm only illumination mode. They have two other units in common living areas, and decide to set these in the alarm and power outage modes so they can easily find their way around in a power outage. Because the present invention is compatible with existing alarm detectors, the family can also utilize basic alarm units in locations where no detector provided illumination is desired. They will still benefit from the interconnection with the non-illumination alarm detectors, in that alarm events detected by the basic units will initiate alarming in all units.

While the invention has been particularly shown and described with reference to preferred embodiments thereof, it will be understood by those skilled in the art that various alterations in form and detail may be made therein without departing from the spirit and scope of the invention. In particular, while the invention illustrated by the figures shows a specific position, size, and shape of the components, they may be varied considerably within the scope of the invention as described herein.

What is claimed is:

1. A multi-module facility safety or security notification system comprising:

a) a centralized control unit;

b) at least one sub-module containing a light source and an ambient light sensor;

c) at least one sub-module containing at least one other sensor that is not an ambient light sensor; and d) a means for providing at least two user selectable illumination options wherein said options comprise:

i) an option wherein the light sources will illuminate in response to the ambient light sensor and said at least one other sensor; and ii) an option wherein the light sources will not illuminate in response to the ambient light sensor but will illuminate in response to said at least one other sensor;

wherein said illumination options can be selected from the central control unit.

2. The multi-module system according to claim 1 wherein the sub-module containing a light source and an ambient light sensor and the sub-module containing at least one other sensor are the same sub-module.

3. The multi-module system according to claim 1 having at least one sub-module that is an input or output device selected from the group consisting of smoke detectors, carbon monoxide detectors, motion detectors, broken glass detectors, and cameras.

4. The multi-module system according to claim 1 having at least one sub-module unit with a mode select switch as a means for providing said at least two user selectable illumination options.

5. The multi-module system according to claim 1 wherein the illumination device is an LED.

6. The multi-module system according to claim 1 wherein the central unit contains a battery backup.

7. The multi-module system according to claim 1 wherein said at least one other sensor is selected from the group consisting of smoke, fire, temperature, specific gas, motion, vibration and loss of primary power sensors.

8. The multi-module system according to claim 1 wherein said at least one other sensor is a smoke, carbon monoxide, or motion detector.

9. The multi-module system according to claim 1 containing an additional user selectable illumination option wherein the light source will also activate in the event of a power outage.

10. A multi-module facility safety or security notification system comprising:

a) a centralized control unit;

b) at least one sub-module containing a light source and an ambient light sensor;

c) at least one sub-module containing at least one other sensor that is not an ambient light sensor;

d) at least one sub-module containing at least one lighting unit not having an ambient light sensor; and e) a means for providing at least two user selectable illumination options wherein said options comprise:

i) an option wherein the light sources will illuminate in response to the ambient light sensor and said at least one other sensor; and ii) an option wherein the light sources will not illuminate in response to the ambient light sensor but will illuminate in response to said at least one other sensor;

wherein said illumination options can be selected from the central control unit.

11. The multi-module system according to claim 10 wherein the lighting responses in all units containing a light source can be determined by detectors in any of the other units in the system via the central control unit.

12. The multi-module system according to claim 10 wherein the sub-module containing a light source and an ambient light sensor and the sub-module containing at least one other sensor are different sub-modules.

* * * * *